US011193491B2

(12) United States Patent
Simon et al.

(10) Patent No.: US 11,193,491 B2
(45) Date of Patent: Dec. 7, 2021

(54) HYDRAULIC POWER UNIT

(71) Applicant: HAWE Hydraulik SE, Aschheim (DE)

(72) Inventors: Thomas Simon, Freising (DE); Gerhard Lörner, Zorneding (DE)

(73) Assignee: HAWE Hydraulik SE, Aschheim (DE)

( * ) Notice: Subject to any disclaimer, the term of this patent is extended or adjusted under 35 U.S.C. 154(b) by 0 days.

(21) Appl. No.: 16/861,456

(22) Filed: Apr. 29, 2020

(65) Prior Publication Data

US 2020/0347847 A1 Nov. 5, 2020

(30) Foreign Application Priority Data

May 3, 2019 (DE) ..... 10 2019 206 333.0

(51) Int. Cl.
*F04C 29/00* (2006.01)

(52) U.S. Cl.
CPC ..... *F04C 29/0085* (2013.01); *F04C 2240/40* (2013.01)

(58) Field of Classification Search
CPC ..... F04C 29/0085; F04C 2240/40
See application file for complete search history.

(56) References Cited

U.S. PATENT DOCUMENTS

| | | | | |
|---|---|---|---|---|
| 6,830,379 | B2 * | 12/2004 | Morita | B60C 23/0408 384/448 |
| 2014/0312720 | A1 * | 10/2014 | Dettenberger | H02K 5/15 310/43 |

FOREIGN PATENT DOCUMENTS

| | | | | |
|---|---|---|---|---|
| DE | 19735403 | C1 | 1/1999 | |
| DE | 59824953 | T2 | 8/2005 | |
| DE | 102012212423 | A1 * | 1/2014 | F04D 29/5806 |
| DE | 102012212423 | A1 | 1/2014 | |
| DE | 102014011228 | A1 | 2/2016 | |
| DE | 102015218960 | A1 | 3/2017 | |
| DE | 10 2016 225 923 | A1 | 6/2018 | |
| DE | 102016225923 | A1 * | 6/2018 | F04B 53/16 |
| DE | 102017215836 | A1 | 3/2019 | |
| EP | 2241753 | A1 | 10/2010 | |

OTHER PUBLICATIONS

Jerman Examination Report dated Nov. 9, 2020.

* cited by examiner

*Primary Examiner* — Connor J Tremarche
(74) *Attorney, Agent, or Firm* — Dinsmore & Shohl LLP

(57) ABSTRACT

A hydraulic power unit has a housing, at least one pump element, a pressure collecting plate and an electric motor. The electric motor has at least one end shield, a stator and a rotor fixed on a rotor shaft. The at least one end shield has at least one partially circumferential functional recess extending between an outer and an inner circumferential surface of the end shield in the direction of a rotor shaft bearing seat. The functional recess thus formed permits the arrangement of functional elements at a central point of the hydraulic power unit in a space-efficient manner without negatively influencing the overall size of the hydraulic power unit.

10 Claims, 8 Drawing Sheets

B – B

HYDRAULIC POWER UNIT

CROSS-REFERENCE TO RELATED APPLICATION

This application claims priority from German Application No. 10 2019 206 333.0 filed May 3, 2019, the entire content of which is incorporated herein by reference.

FIELD OF THE INVENTION

The present invention relates to a hydraulic power unit with a housing, at least one pump element, a pressure collecting plate and an electric motor with at least one end shield.

BACKGROUND OF THE INVENTION

Hydraulic power units known from the prior art regularly comprise a housing, at least one pump element, a pressure collecting plate and an electric motor. Pump elements used are, for example, radial piston pumps, gear pumps or other pump elements known from the state of the art. The hydraulic fluid delivered by the pump element is regularly brought together in a pressure channel arranged in the pressure collecting plate before it is fed to a pressure connection provided in a connection block in the housing of the hydraulic power unit and prepared for introduction into a hydraulic system.

The electric motor used in such hydraulic power units is usually a submerged electric motor that drives the at least one pump element. The electric motor regularly has at least one end shield, one stator and one rotor fixed on a rotor shaft. Classically, two end shields are used in electric motors to support the rotor shaft. However, in the state of the art, end shields are also known to have both a rotor shaft bearing seat and a stator retaining collar. The stator is fixed in the stator retaining collar and the rotor shaft is rotatably mounted in a bearing unit disposed in the rotor shaft bearing seat.

The housing of the hydraulic power unit regularly defines an interior space sealed to the outside, which forms a reservoir for the hydraulic fluid to be delivered by the pump element and in which the at least one pump element, the pressure collecting plate and the electric motor are also located. In general, the pressure collecting plate is arranged between the at least one pump element and the electric motor in the axial direction of the expansion of the rotor shaft. In particular, the pressure collecting plate is arranged between the at least one pump element and the lower end shield of the electric motor, wherein the rotor shaft passes through both the lower end shield and the pressure collecting plate in order to drive the at least one pump element. The electric motor is regularly connected to the housing on only one side, which is usually the side facing the at least one pump element.

Due to the axial expansion of the bearing unit, which supports the rotor shaft in the lower end shield, there is installation space in the area of the lower end shield radially outside the bearing unit which remains unused.

An example of how to use this installation space or reduce unused installation space is shown in EP 2 241 753 A1. Here, the end shield and pressure collecting plate are combined and designed as a single component, so that, for example, a pressure collecting ring channel for several radial piston elements is arranged radially outside the bearing unit in the end shield/pressure collecting plate combination, here called the support plate. However, such a combined solution of pressure collecting plate and end shield may not always be feasible or useful, for example for manufacturing or functional reasons.

In hydraulic power units in general, it is also desirable to return the returning hydraulic fluid into the reservoir formed by the housing at a point which, on the one hand, is sufficiently distanced from the suction point of the at least one pump element and, on the other hand, is below a hydraulic fluid level which is established in the reservoir. This ensures that the hydraulic fluid which has just been heated by the hydraulic system is not directly sucked in and delivered again by the pump element. The return flow below the hydraulic fluid level prevents foaming in the reservoir, which occurs when the return flow is above the hydraulic fluid level and the returned hydraulic fluid meets the hydraulic fluid in the reservoir from above. An example of a channel element that manages such a return flow is shown in DE 10 2016 225 923 A1.

SUMMARY OF THE INVENTION

In view of this, it is the object of the present invention to provide a hydraulic power unit with an end shield which allows efficient use of the installation space for extended functionalities of the hydraulic power unit.

The solution of the object is achieved by a hydraulic power unit as disclosed herein. Preferable further embodiments are also described herein.

The hydraulic power unit according to the invention comprises a housing, at least one pump element, a pressure collecting plate and an electric motor with at least one end shield, a stator and a rotor fixed on a rotor shaft. The at least one end shield has a rotor shaft bearing seat and a stator retaining collar, the stator being fixed in the stator retaining collar and the rotor shaft being rotatably mounted in a bearing unit disposed in the rotor shaft bearing seat. The at least one end shield has at least one partially circumferential functional recess extending partially between an outer circumferential surface and an inner circumferential surface of the end shield in the direction of the rotor shaft bearing seat. The pressure collecting plate is formed separately from the end shield or is provided a separate component respectively.

The inner circumferential surface is usually formed by the radial inner wall of the rotor shaft bearing seat. The outer circumferential surface is formed by a radial outer wall of the at least one end shield, which also extends axially essentially at the same height as the rotor shaft bearing seat.

In a functional recess configured in this way, a wide variety of functional elements of the increasingly complex hydraulic power units can be arranged, thus ensuring efficient use of installation space that does not lead to an increase in the size of the hydraulic power unit despite increased functionality.

Preferably, the at least one functional recess is open essentially over its entire surface in the direction of the pressure collecting plate. In particular, the pressure collecting plate arranged axially below the end shield closes the open functional recess essentially completely in the axial direction. In this way, the functional recess can be manufactured simply and cost-effectively and at the same time the full functionality of the functional recess can be guaranteed.

Preferably, the at least one functional recess is a sensor unit receiving recess or a return flow channeling recess. Hence, the geometry of the functional recess can be specifically adapted to the required functionality.

Preferably, the at least one end shield has a further functional recess, one functional recess being a sensor unit receiving recess and the other functional recess being a return flow channeling recess. In this way, different functionalities can be realized simultaneously within the end shield, which results in an additional increase in efficiency with regard to the installation space used.

Preferably, a sensor unit is at least partially disposed in the sensor unit receiving recess. In particular, the sensor unit is configured as an under-oil sensor unit. Thus, the sensor unit can be disposed in the functional recess in a space-efficient manner and connected to sensor elements arranged in the interior of the hydraulic power unit, which for example monitor the filling level or the quality of the hydraulic fluid in the hydraulic power unit. The sensor unit is connected to a higher-level control system, usually located outside the housing, for evaluation of the recorded data.

Preferably, a sensor disc is fixed on the rotor shaft and the sensor unit detects the speed of the rotor shaft in combination with the sensor disc. The sensor disc is especially configured like a gearwheel and is made of metal. In particular, the sensor unit and the sensor disc partially overlap in the axial direction. Due to the gearwheel-like design of the sensor disc, the sensor unit can detect the speed of the rotor shaft during operation by means of the gaps in the gearwheel-like sensor disc, since the sensor disc rotates integrally with the rotor shaft. It is also conceivable, of course, that the speed is determined by a magnetic method, for example by a Hall sensor.

Preferably, a return channel with a return inlet area and a return outlet area spaced from the return inlet area is arranged in the return flow channeling recess. In particular, the return outlet area opens into a reservoir for hydraulic fluid formed by the housing. Thus, a return channeling is realized in the functional recess, which returns the hydraulic fluid returned from the hydraulic system into the reservoir at a point which on the one hand is sufficiently spaced from the suction point of the at least one pump element and on the other hand lies below a hydraulic fluid level which established in the reservoir. This ensures that the hydraulic fluid which has just been heated by the hydraulic system is not pumped directly back from the pump element, and foam formation in the reservoir is avoided.

Preferably, the return channel is integrally provided with the end shield and forms the return flow channeling recess. As a result, fewer individual parts are required, which facilitates the installation of the hydraulic power unit.

Preferably, the at least one end shield is provided separately from the housing and is attached to a mounting flange of the housing. Due to the complex geometry of the at least one functional recess, separate production of the housing and end shield makes sense in order to reduce the complexity of production. The housing can also be provided as a cast part, for example, with the end shield designed as a milled part.

Preferably, the at least one end shield is mounted on the mounting flange in a vibration-damping manner. In particular, at least one elastic washer is arranged between the end shield and the mounting flange. The vibration-damping mounting of the end shield reduces the transmission of vibrations from the electric motor to the housing of the hydraulic power unit. Thus, the hydraulic power unit operates at a particularly low noise level and the vibrations generated by the electric motor are not or only to a small extent transmitted to the housing.

BRIEF DESCRIPTION OF THE DRAWINGS

In the following, the invention is explained in more detail by means of exemplary embodiment shown in the figures. Herein it is shown schematically.

DETAILED DESCRIPTION OF THE INVENTION

Figure 1:
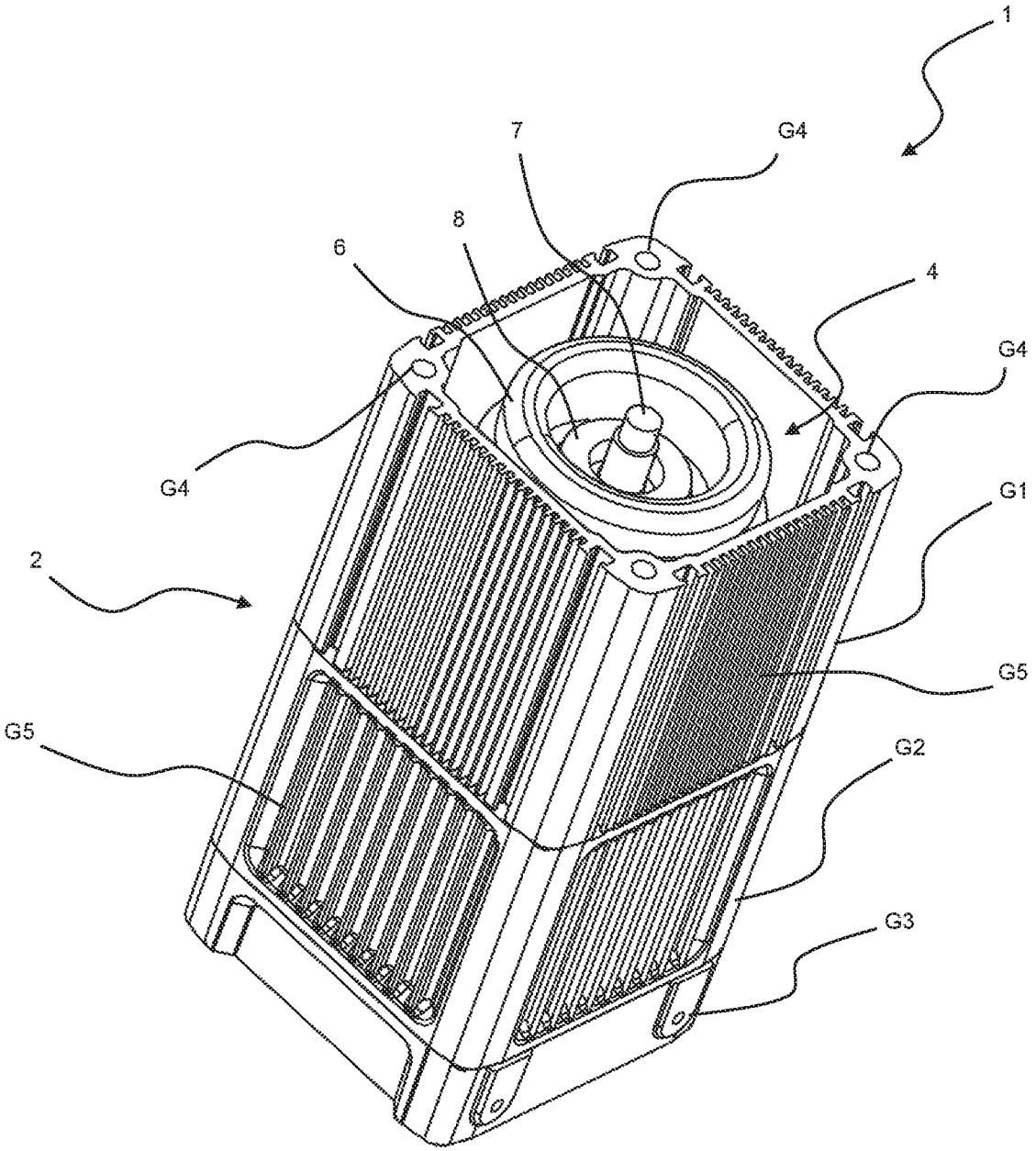
FIG. 1 is a perspective view of a hydraulic power unit without upper cover according to the invention.

FIG. 1 shows an embodiment of a hydraulic power unit 1 without upper cover and without upper end shield.

Figure 3:
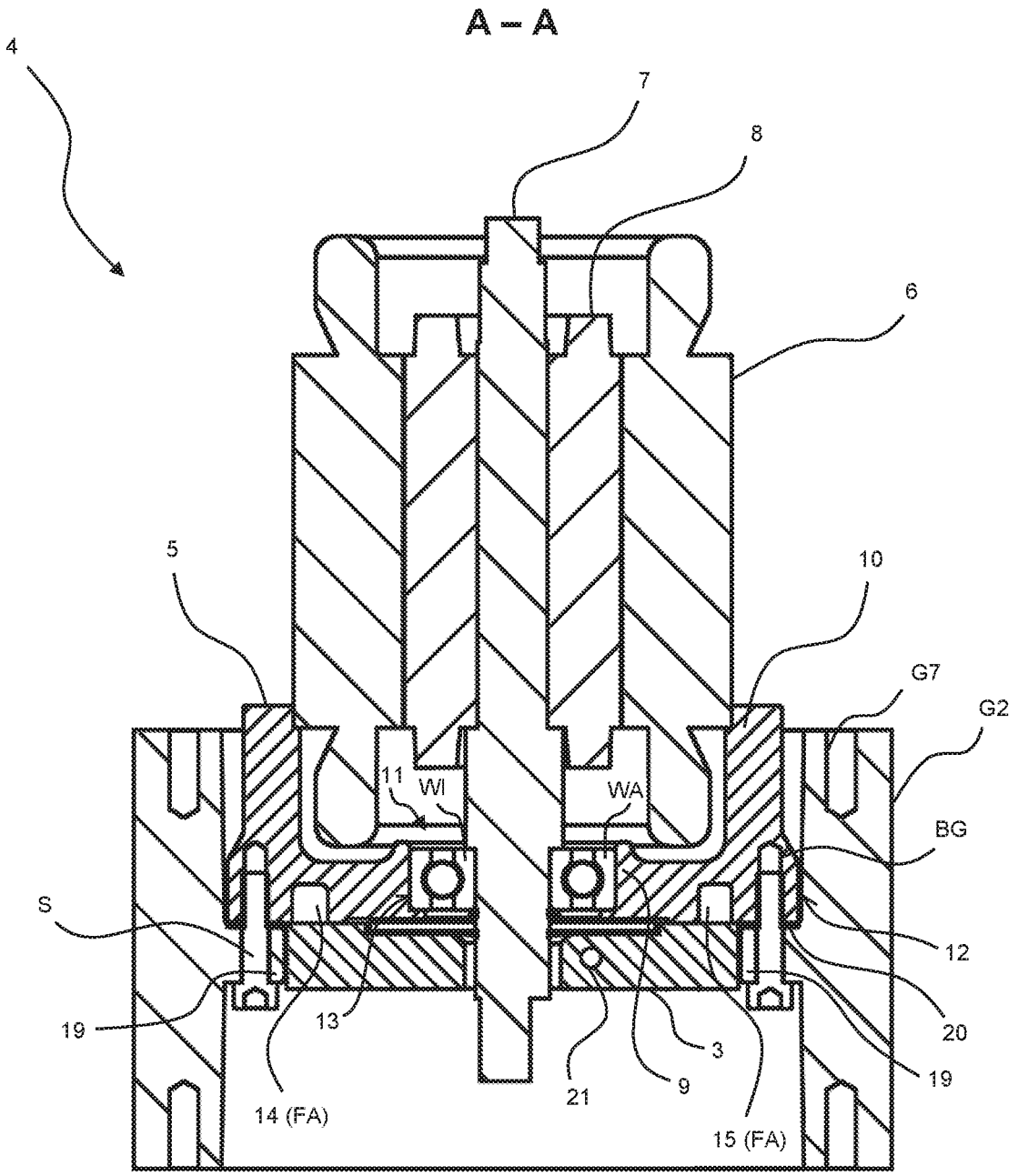
FIG. 3 is a sectional view of the components essential to the invention along the section line A-A shown in FIG. 3.

The hydraulic power unit 1 comprises a housing 2, at least one pump element (not shown), a pressure collecting plate 3 and an electric motor 4 with a lower end shield 5, see FIG. 3 The electric motor 4 also has a stator 6 and a rotor 8 fixed on a rotor shaft 7. In order to drive the at least one (not shown) pump element, the rotor shaft 7 in this embodiment is provided with an eccentric member at the corresponding end, see FIGS. 3 and 6. Here, the pump element is a radial piston pump. When configured as a gear pump, for example, the rotor shaft 7 would be provided without an eccentric member. The lower end shield 5 has a rotor shaft bearing seat 9 and a stator retaining collar 10, see FIG. 3. The stator 6 is fixed in the stator retaining collar 10 and the rotor shaft 7 is rotatably mounted in a bearing unit 11 disposed in the rotor shaft bearing seat 9.

The terms "axial" and "radial" used in the following always refer to the rotor shaft 7.

As shown in FIG. 1, the housing 2 comprises of a first housing element G1, a second housing element G2, a lower cover G3 and an upper cover (not shown). The use of several axially superimposed first housing elements G1 between the second housing element G2 and the upper cover is also conceivable, for example to increase the capacity of reservoir R for the hydraulic fluid formed in the interior of the housing 2. The upper cover and the upper end shield not shown in FIG. 1 allow for a view of the electric motor 4 with stator 6, rotor shaft 7 and rotor 8 arranged inside the housing 2. In this embodiment, the electric motor 4 is an under-oil electric motor. The first housing element G1 comprises four fixing holes G4 and, like the second housing element G2, a plurality of cooling fins G5. The first housing element G1 is preferably an extruded component made of aluminum or an aluminum alloy. This allows the length of the housing element G1, and thus the capacity of the reservoir R, to be adjusted variably without having to use additional housing elements G1. As further shown in FIG. 3, the second housing element G2 has fixing holes G7 for fixing the lower cover G3 as well as the first housing element G1 and the upper cover. Between the housing elements G1 and G2 and the covers G3 there are furthermore sealing members, in particular flat sealing members, which are not shown here, which seal the reservoir R formed in the interior of housing 2.

Figure 2:
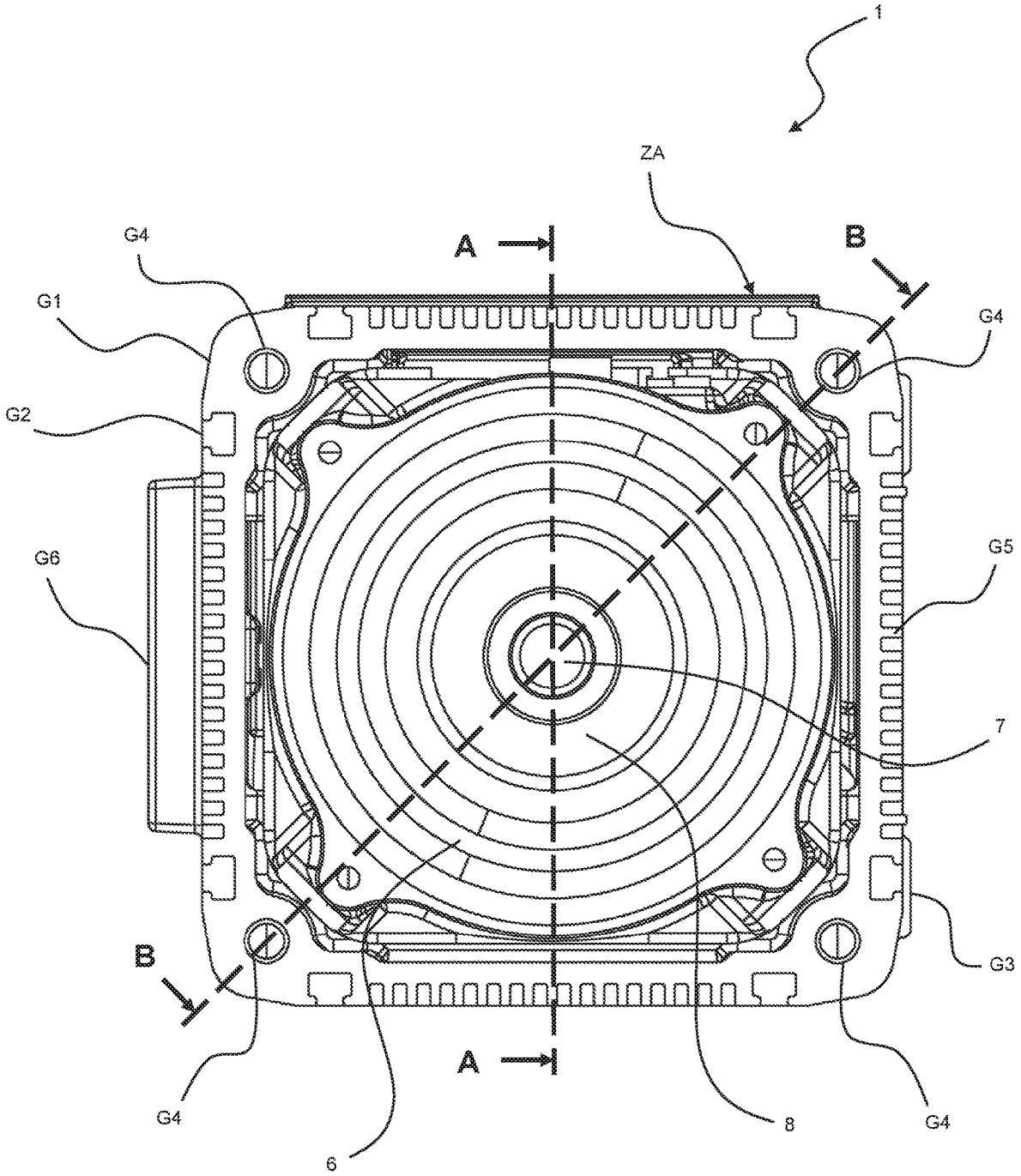
FIG. 2 is a top view of the hydraulic power unit from FIG. 1.
Figure 4:
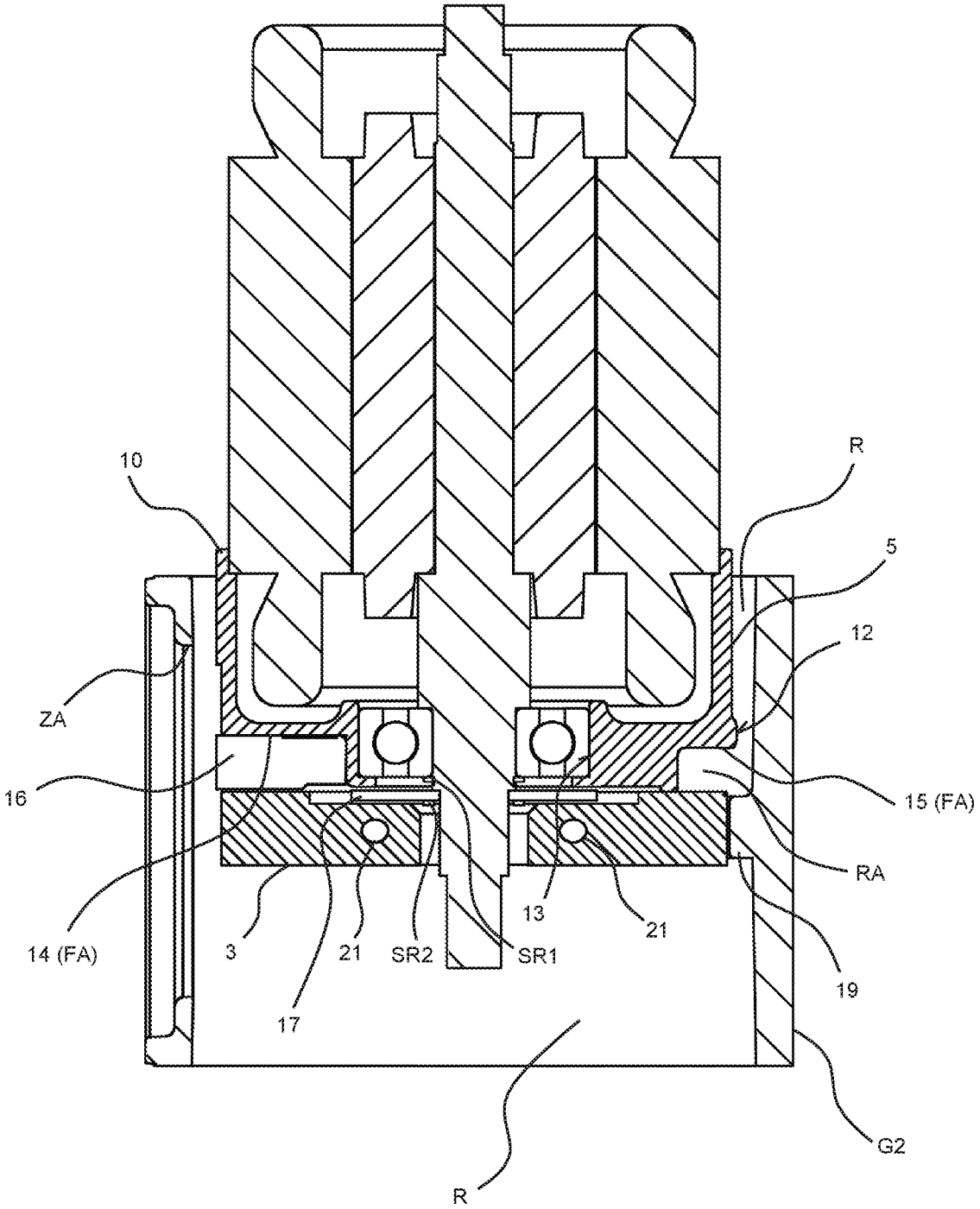
FIG. 4 is a sectional view of the components essential to the invention along the section line B-B shown in FIG. 3.

FIG. 2 shows a top view of the hydraulic power unit shown in FIG. 1, in which the section lines A-A and B-B are drawn for the cross sections shown in FIGS. 3 and 4. In addition, FIG. 2 shows a connection block G6, which is used to connect the hydraulic power unit 1 to a hydraulic system. The connection block G6 has at least one return connection and at least one pressure connection, neither of which is shown here.

The lower end shield 5 has an outer circumferential surface 12 and an inner circumferential surface 13, see FIG. 3 In this embodiment, the inner circumferential surface 13 is formed by the radial inner wall of the rotor shaft bearing seat 9, in which the outer ring WA of the bearing unit 11, here provided as a ball bearing, is seated. The outer circumferential surface 12 of the lower end shield 5 extends axially at essentially the same height as the inner circumferential surface 13. The inner ring WI of the bearing unit 11 is fixed on the rotor shaft 7 on one side by a stop and on the other side by a snap ring SR1.

Figure 5:
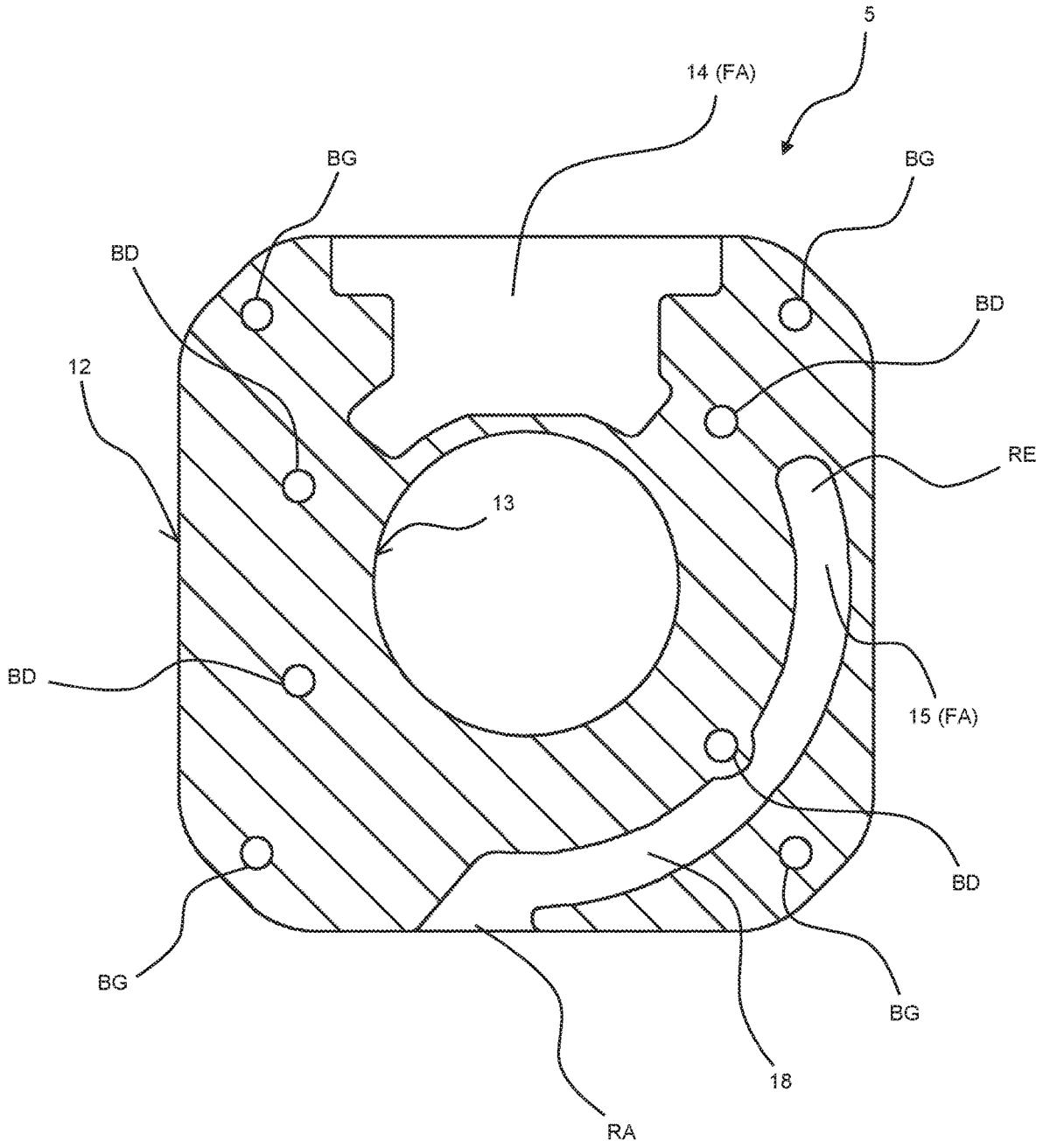
FIG. 5 is a bottom view of the end shield shown in FIG. 4 with functional recesses.
Figure 6:
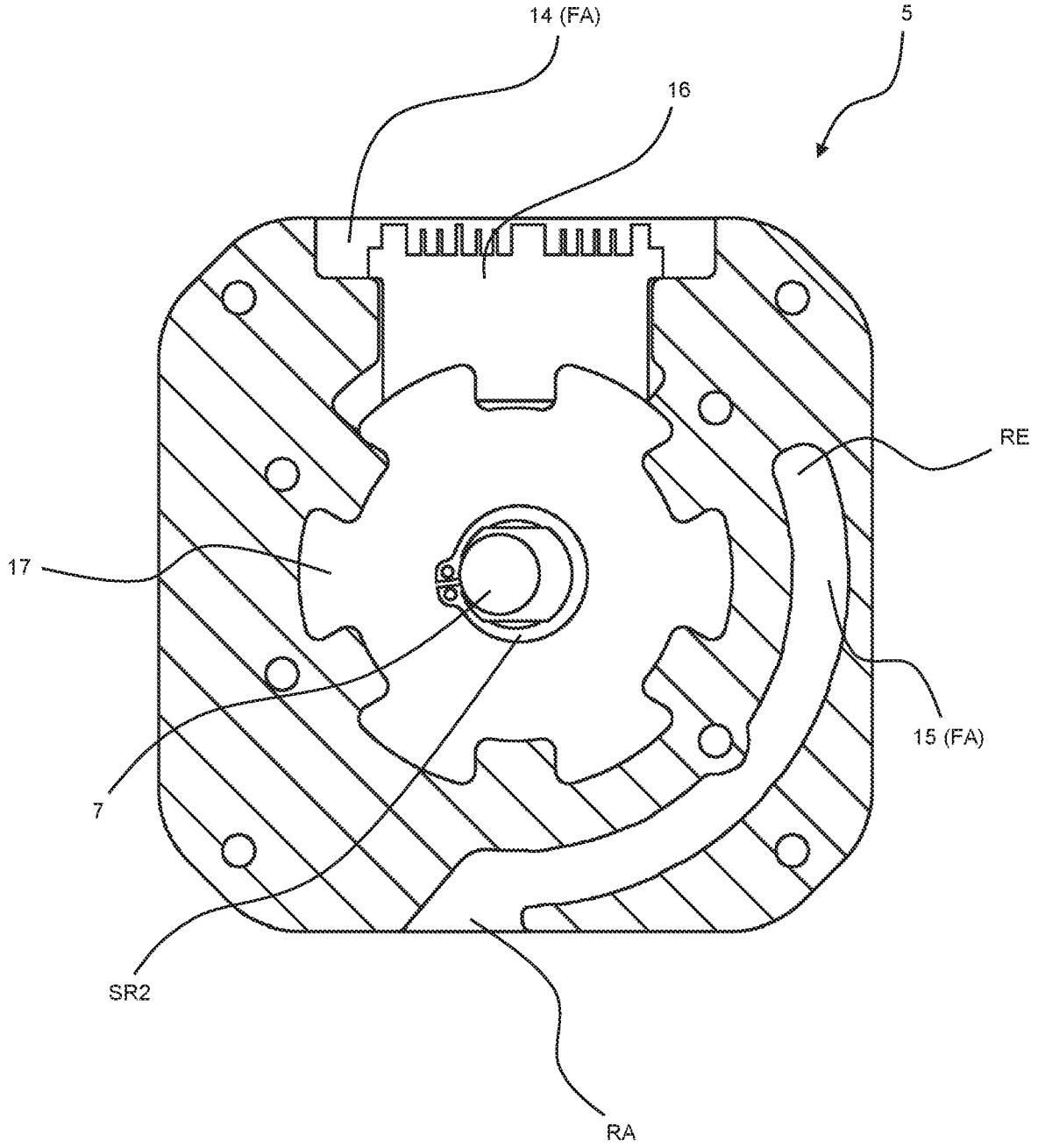
FIG. 6 is the view from FIG. 5 with sensor unit, sensor disc and rotor shaft.

As shown in FIGS. 3 to 6, the lower end shield 5 has two partially circumferential functional recesses FA extending partially between the outer circumferential surface 12 and the inner circumferential surface 13 of the end shield 5 in the direction of the rotor shaft bearing seat 9. FIGS. 5 and 6 clearly show that "partially circumferential" here means an extension around the axis of the rotor shaft 7 which differs substantially from known recesses such as a simple bore. The difference becomes clear when comparing the mounting holes BD and BG, which will be described in detail later.

FIGS. 5 and 6 show a bottom view of the end shield 5 from the pressure collecting plate 3. In this embodiment, the functional recesses FA are open over their entire surface in the direction of the pressure collecting plate 3. In this embodiment, one functional recess FA is designed as sensor unit receiving recess 14, the other as return flow channeling recess 15.

A sensor unit 16 is disposed in the sensor unit receiving recess 14. As can be seen in FIGS. 4 and 6, in this embodiment the sensor unit 16 is arranged almost completely in the sensor unit receiving recess 14 in the end shield 5 and is held from below by the pressure collecting plate 3. An access recess ZA in the second housing element G2 enables the sensor unit 16 to be connected to a higher-level control system arranged outside the housing 2, not shown, for evaluation of the data recorded by the sensor unit 16, see FIG. 4.

As shown in FIGS. 3, 4 and 6, a sensor disc 17 is fixed on the rotor shaft 7 by means of a snap ring SR2. Other known constructive solutions for fixing the sensor disc 17 on the rotor shaft 7 are also conceivable. The sensor disc 17 has a gearwheel-like design, is made of metal and partially overlaps with the sensor unit 16 in the axial direction, see FIG. 6. By the change between tooth and gap during the rotation of the rotor shaft 7, the sensor unit 16 can thus detect the speed of the rotor shaft 7 and transmit it to the higher-level control system.

In the return flow channeling recess 15 a return channel 18 with a return inlet area RE and a return outlet area RA spaced from it is arranged. As can be seen in FIG. 4, the return flow outlet area RA opens into the reservoir R for the hydraulic fluid formed by housing 2. In this embodiment, the return channel 18 is formed integrally with the end shield 5 and forms the return flow channeling recess 15. From below, the return channel 18 is essentially completely closed off by the pressure collecting plate 3, see FIGS. 3, 4 and 8.

Instead of a return channel 18, which is integrally provided with the lower end shield 5, a return channel would also be conceivable, which is designed as a separate component. In this case, the return flow channeling recess 15 could be designed geometrically variable and the return channel could be arranged in the return flow channeling recess 15 as required.

As shown in FIG. 3, the lower end shield 5 is provided separately from the housing 2 and is attached to a mounting flange 19. For fastening to housing element G2, the lower end 5 shield comprises fastening holes BG. The lower end shield 5, and thus the entire electric motor 4, is fastened to the housing 2 with the appropriate screws S. The lower end shield 5 does not rest directly on the mounting flange 19, but on elastic washers 20, which ensure vibration damping of the lower end shield 5 on the mounting flange 19. Instead of the elastic washers 20, rubber buffers or rubber-bonded metals can be used alternatively for the vibration damping support.

The mounting flange 19 is partially circumferential, as shown in FIG. 4, and in combination with the pressure collecting plate 3 forms a partial separation of the reservoir R. Thus, the arrangement of the return line outlet area RA above the mounting flange 19 ensures that the heated hydraulic fluid returned from the hydraulic system is returned to the reservoir R at a distance from the pump element located below the pressure plate 3, which is not shown. This ensures that the hydraulic fluid spends sufficient time within the reservoir R to cool down before being pumped back into the hydraulic system.

Figure 8:
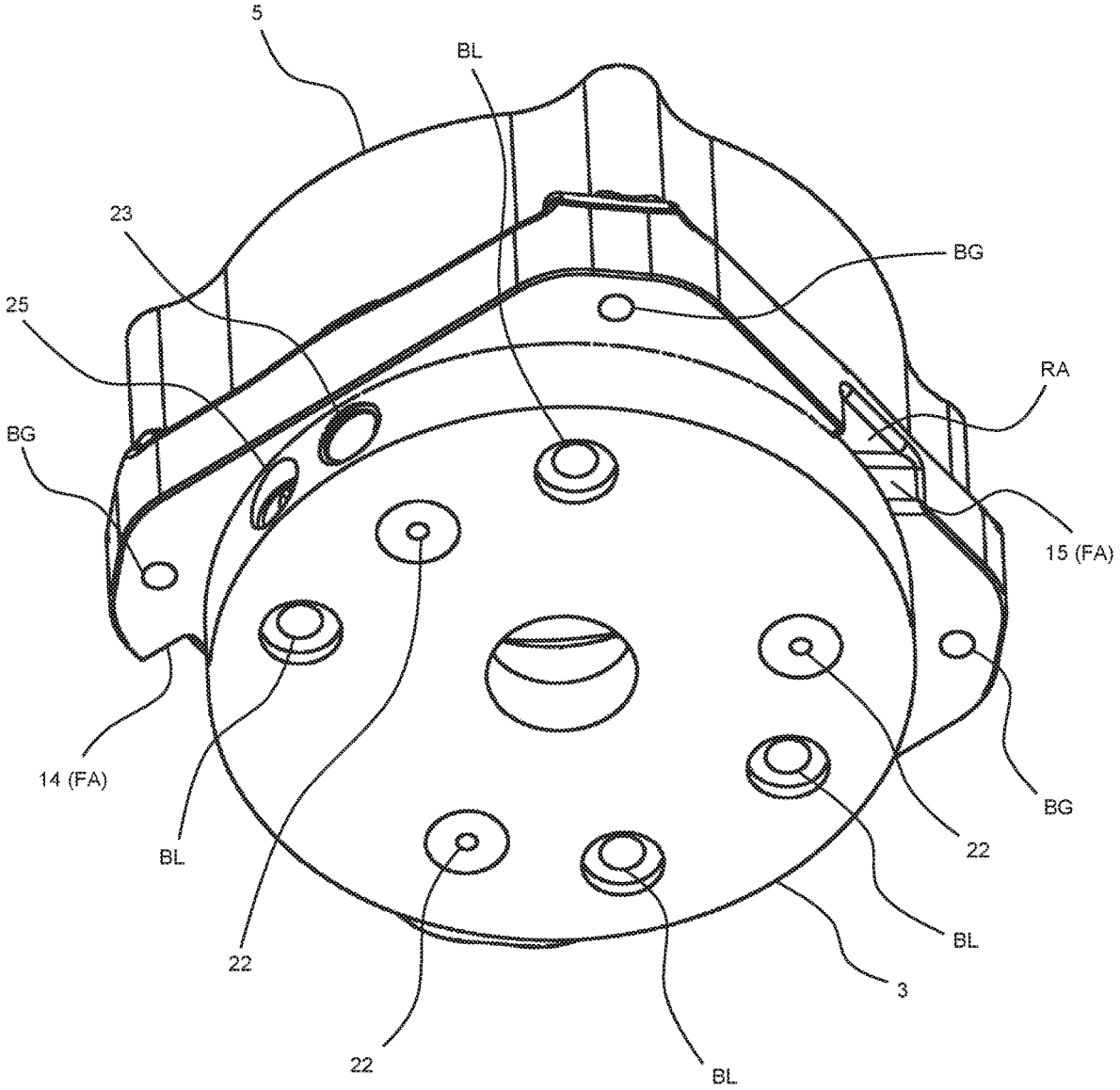
FIG. 8 is a perspective view of the pressure collecting shown in FIG. 8 and the end shield.

The pressure collecting plate 3 is located below the end shield 5, see FIGS. 3, 4 and 8, and has a pressure channel 21 into which the hydraulic fluid delivered by at least one pump element located below the pressure collecting plate 3 is introduced via pressure channel inlets 22. The pressure channel 21, which is designed as a multi-core channel here, see FIG. 4, conducts the hydraulic fluid delivered by the pump element from a pressure channel outlet 23 via a not shown connecting channel through the second housing element G2 to the pressure connection in the connection block G6.

Figure 7:
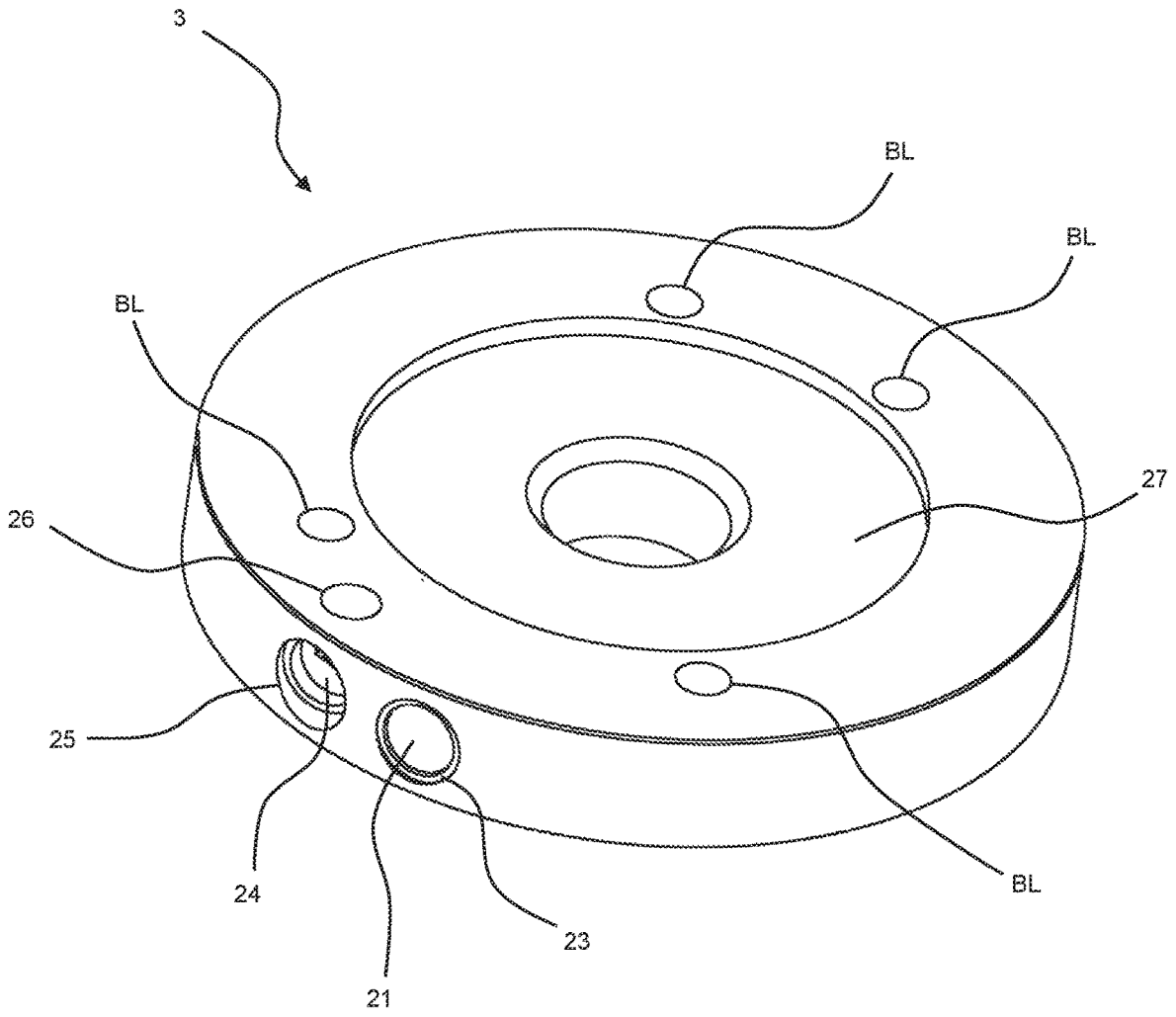
FIG. 7 is a perspective view of a pressure collection plate.

As shown in FIG. 7, the pressure collecting plate 3 in this embodiment comprises a return connection channel 24, which extends in an L-shape from a return connection channel inlet 25 to a return connection channel outlet 26. Into the return connection channel inlet 25 opens a not shown connection channel which connects the return connection of the connection block G6 through the second housing element G2 to the pressure collecting plate 3. The return connection channel outlet 26 opens into the return inlet area RE of the return channel 18 in the lower end shield 5, which is located axially above the pressure collecting plate 3.

Furthermore, the pressure collecting plate has 3 fixing holes BL for fixing to the lower end shield 5 by means of fixing means not shown. FIG. 7 also shows a disc-shaped recess 27 in the pressure collecting plate 3, in which the sensor disc 17 is arranged between the pressure collecting plate 3 and the lower end shield 5 in the assembled state.

LIST OF REFERENCE SIGNS

1 hydraulic power unit
2 housing
3 pressure collecting plate
4 electric motor
5 lower end shield
6 stator
7 rotor shaft
8 rotor
9 rotor shaft bearing seat

10 stator retaining collar
11 bearing unit
12 outer circumferential surface
13 inner circumferential surface
14 sensor unit receiving recess
15 return flow channeling recess
16 sensor unit
17 sensor disc
18 return channel
19 mounting flange
20 elastic washer
21 pressure channel
22 pressure channel inlet
23 pressure channel output
24 return connection channel
25 Return connection channel inlet
26 return connection channel outlet
27 disc-shaped recess
BD, BG, BL mounting hole
FA functional recess
G1 first housing element
G2 second housing element
G3 Lower cover
G4 fixing hole
G5 cooling fin
G6 connection block
G7 fixing hole
R Reservoir
RA return outlet area
RE return inlet area
S screw
SR1, SR2 snap ring
WA outer ring of the bearing unit
WI inner ring of the bearing unit
ZA access recess

The invention claimed is:

1. A hydraulic power unit, comprising:
a housing;
at least one pump element for delivering hydraulic fluid;
a pressure collecting plate comprising a pressure channel; and
an electric motor comprising:
at least one end shield having a rotor shaft bearing seat and a stator holding collar, a bearing unit disposed in the rotor shaft bearing seat, the at least one end shield having at least one partially circumferential functional recess having a radial width extending partially between an outer circumferential surface and an inner circumferential surface of the at least one end shield with respect to the rotor shaft bearing seat;
a stator fixed in the stator holding collar; and
a rotor fixed on a rotor shaft, the rotor shaft being rotatably mounted in the bearing unit for rotation about a rotor axis;
wherein the at least one partially circumferential functional recess extends around the rotor axis;
wherein the at least one partially circumferential functional recess is a sensor unit receiving recess or a return flow channeling recess
wherein the hydraulic fluid delivered by the pump element is brought together in the pressure channel and fed to a pressure connection.

2. The hydraulic power unit according to claim 1, wherein the at least one functional recess is open substantially over its entire surface in a direction of the pressure collecting plate.

3. The hydraulic power unit according to claim 1, wherein the at least one functional recess comprises two functional recesses, one functional recess being a sensor unit receiving recess and the other functional recess being a return flow channeling recess.

4. The hydraulic power unit according to claim 3, further comprising a sensor unit at least partially disposed in the sensor unit receiving recess.

5. The hydraulic power unit according to claim 4, further comprising a sensor disc fixed on the rotor shaft, the sensor unit detecting a speed of the rotor shaft in combination with the sensor disc.

6. The hydraulic power unit according to claim 3, wherein the return flow channeling recess comprises a return channel having a return inlet area and a return outlet area spaced from the return inlet area.

7. The hydraulic power unit according to claim 1, wherein the at least one end shield is formed separately from the housing and is attached to a mounting flange of the housing.

8. The hydraulic power unit according to claim 7, wherein the at least one end shield is mounted on the mounting flange in a vibration-damping manner.

9. The hydraulic power unit according to claim 1, wherein the at least one partially circumferential functional recess is not a bore through the at least one end shield.

10. The hydraulic power unit according to claim 1, further comprising a reservoir for the hydraulic fluid, wherein the at least one circumferential functional recess comprises the return flow channeling recess and has a return outlet area opening into the reservoir.

* * * * *